United States Patent [19]

Rangel-Garza

[11] 4,331,293

[45] May 25, 1982

[54] EMITTERS FOR DRIP IRRIGATION SYSTEMS, MICRO-SPRINKLERS AND SIMILARS, OF THE PRESSURE COMPENSATING TYPE AND ALSO THOSE TYPES WHOSE FLOW VARIES IN RELATION TO THE CHANGES IN PRESSURE

[76] Inventor: Javier Rangel-Garza, Rio Danubio #117 Col. Del Valle, Garza Garcia, Nuevo Leon, Mexico

[21] Appl. No.: 96,751

[22] Filed: Nov. 23, 1979

[51] Int. Cl.[3] ..... B05B 15/02

[52] U.S. Cl. ..... 239/542; 138/45

[58] Field of Search ..... 239/542, 547, 271, 553, 239/570, 590, 272; 138/45, 46, 40, 44; 137/513.5; 251/120, 121, 126

[56] References Cited

U.S. PATENT DOCUMENTS

| | | | |
|---|---|---|---|
| 3,667,685 | 6/1972 | Rinkewich | 239/542 |
| 4,105,162 | 8/1978 | Drori | 239/542 X |
| 4,106,525 | 8/1978 | Currie et al. | 138/45 X |
| 4,132,364 | 1/1979 | Harmony | 239/271 X |
| 4,177,947 | 12/1979 | Menzel | 138/45 X |
| 4,193,545 | 3/1980 | Havens | 239/542 X |
| 4,226,368 | 10/1980 | Hunter | 239/542 |

*Primary Examiner*—Robert B. Reeves
*Assistant Examiner*—Gene A. Church
*Attorney, Agent, or Firm*—James C. Nemmers; Haven E. Simmons

[57] ABSTRACT

An emitter for use in irrigation systems of either the pressure compensating or variable flow type which emitter has an improved means of filtering and removing impurities so as to minimize the possibility of clogging. The emitter includes a first filter located inside of the fluid line or hose so as to eliminate most of the particles from ever entering the emitter. The emitter also includes structure so that once the fluid enters the emitter it is subjected to a cyclone path while going through multiple decompression chambers. This cyclone type turbulent path deposits the impurities against the outside walls of the decompression chambers where they accumulate in a collecting chamber for easy removal.

7 Claims, 16 Drawing Figures

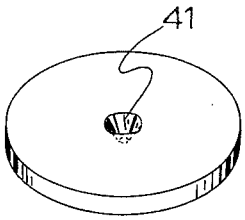
Fig.7
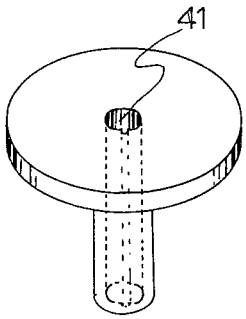
Fig.7A
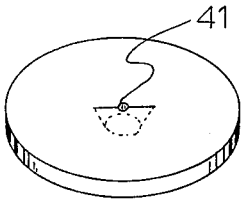
Fig.7B
Fig.8A
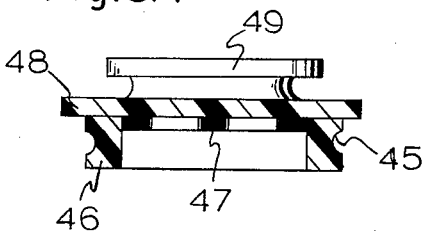
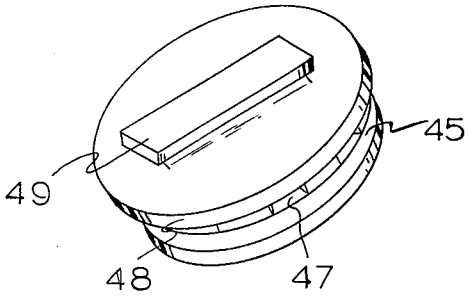
Fig. 8B

EMITTERS FOR DRIP IRRIGATION SYSTEMS, MICRO-SPRINKLERS AND SIMILARS, OF THE PRESSURE COMPENSATING TYPE AND ALSO THOSE TYPES WHOSE FLOW VARIES IN RELATION TO THE CHANGES IN PRESSURE

This invention refers to Improvements to emitters for drip irrigation systems, micro-sprinklers and similars, of the pressure compensativity type and also those types whose flow varies in relation to the changes in pressure, whose combination of the parts which form it permits an improved function of the emitter, since it has a micro-filter formed in the extreme lower part of the pivot which is inserted in the driping hose or micro-sprinkling line, through which the liquid which comes out through the emitters flows once its flow is regulated. Said micro-filter, because of its location inside the hoses of dripper or sprinkling lines, will stop the particles which are in the flow of water from entering into the inside of the emitter, avoiding the obstruction of the emitter and at the same time, permitting all of the particles which could not enter into the emitter and which stayed in the dripper of sprinkling hoses, to be easily dislodged upon flushing the lines at their extreme ends, during the normal maintenance of the irrigation systems.

Also, the duct takes the shape of a spiral within the pivot, upon the spiral rod which forms an integral part of the male section of the emitter, thanks to the length and dimension of said spiral duct, the water and particles coming in the flow of water which were able to pass through the micro-filter are permitted to flow at high speed, in this way impeding said particles to be deposited on the walls of the spiral duct and permitting the planned flow of water to pass to the next decompression chamber.

At the same time the flow of water under pressure which flows through the hose and passes from the micro-filter, to the spiral duct and crop out into the lower reception chamber of the emitter will form a whirlpool within said chamber which will also help lessen the pressure of this liquid, thanks not only to the friction within the spiral duct, but also to that exerted against the walls of the lower reception chamber due to this cyclone-like action.

These methods of decompression can also act as pressure or flow compensators, since the pressure of the liquid within the dripper or micro-sprinkling hose increases, the same will increase the speed and friction of the liquid within the duct and lower reception chamber and compensate in a great part the increase of pressure originated in the dripper or micro-sprinkling hose.

There is also a second decompression chamber which also causes a cyclone-like action due to the form and trajectory of the orifice which permits the entrance of the liquid into this second chamber and which connects with the aforementioned first chamber through a duct which can be straight, spiral or of alternate steps. Said cyclone-like action will separate the heavier particles which are in the liquid or flow of water, precipitating them towards the walls and down the same, where said chamber has exit grooves which are found connected towards a peripheric chamber where the particles can accumulate; the cyclone-like action in this chamber also permits the diminishing and compensating action of the pressure of flow, in the same way as in the ducts and lower chamber; this cyclone-like action permits the water, liberated of the heavier particles, to flow with greater ease through the last decompression orifice or exit, and thanks to the aforementioned successive losses of pressure, this orifice can be a greater diameter than if the orifice had been calculated to operate a grater pressure, or at the pressure with which the water flows in the interior of the dripper or micro-sprinkling hoses, allowing the particles which have avoided the cleaning action in the trajectory not to obstruct the aforementioned final exit orifice, since they are smaller in size than this, so a greater uniformity of the flow of the emitters can be guaranteed.

Another characteristic is the cleaning valve, formed by an orifice in the female section which is found closed by the action of the floodgate which forms an integral part of the male section, and can be opened by manually turning the male section inside the female section, permitting the exit of impurities. To facilitate this maneuver the female section has two flat sections formed opposite each other on the exterior walls of said section.

Another of the characteristics is that the exit or final decompression orifice can be made of elastic material which permits the diameter to expand or increase in case particles obstruct it in spite of the cleaning mechanisms, thanks to the greater pressure which the liquid will exert on this elastic material, when the pressure of the liquid contained in the second decompression chamber of the emitter equals that of the water flow within the dripper or micro-sprinkling hoses, and in this way the particles which obstruct it can be ejected, immediately returning afterwards to its original form and dimension.

This final decompression orifice or exit made of an elastic material, due to its dimensions and form, can also be designed to compensate changes in pressure which can originate in the second decompression chamber, due to the changes found in the flow or water within the dripper or micro-sprinkling hoses, if these have not been previously compensated by friction or cyclone-like action of the different means that this mechanism has. In said case the orifice can also be of larger dimensions than those necessary than when it works by direct pressure of the dripper or micro-sprinkling hoses.

Lastly it has: First, a plug or grooved head in case it functions as a dripper and second, it has cavities, ducts and special orifices in case if functions as a sprinkler.

In the first case the grooves will impede the entrance of extraneous particles into the inside of the emitter and it will also impede the evaporation of the water and consequently the precipitation of salts directly on the final decompression orifice or exit. In the second case, when one wishes to operate the emitter as a sprinkler, the final decompression orifice or exit and the grooved plug can be eliminated and can be substituted with a sprinkler head which has its exit duct integrated.

The object of this invention is to contribute all the advantages described previously so they can all be used together or separately in the emitters which are now found on the market and the emitter which is described here, permitting the production of pressure compensation units with ducts or orifices sufficiently big enough so that they are not as easily obstructed as those in existence, the action of the micro-filter be confined within the dripper or micro-sprinkling hoses to facilitate the elimination of impurities, in the case of drippers with a variable flow, they permit the automatic ejection of extraneous particles when the final exit orifice is obstructed, which will permit the use of lower quality water than that which is now indispensable to use in systems of irrigation by dripping therefore permitting the reduction of costs in central filtering units, and the ability to automatic to the maximum possible the maintenance of the systems of irrigation, therefore obtaining great savings in labor and also receiving a more uniform irrigation.

The novel characteristics which this invention has and can be integrated jointly or separately in this or any other emitter, which are found clearly described in the following description, and in the drawings which accompany it. The same serve as points of reference to indicate the same parts in the drawings shown.

FIG. 7 is a conventional perspective of the disc made of elastic material, and showing the final exit orifice, which can function as a pressure or flow compensator.

FIG. 7A shows a perspective of another method for a pressure of flow compensator, also formed of elastic material.

FIG. 7B shows a conventional perspective of a self-cleaning mechanism.

FIGS. 8A and 8B show a front crossview and a conventional perspective of the plug.

Figure 1:
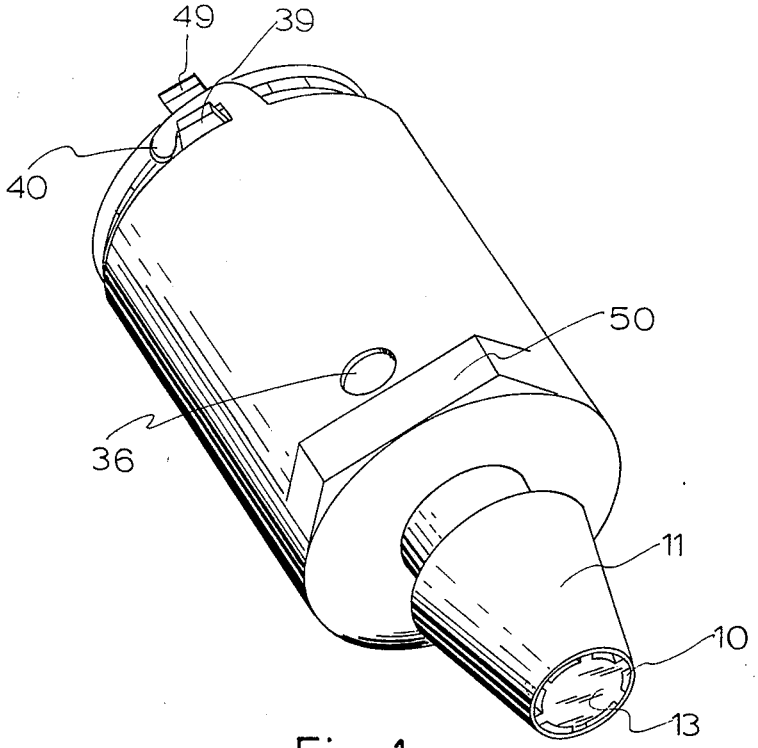
FIG. 1 is a conventional perspective of the emitter.

With reference to said drawings, this emitter is found integrated basically by the female section (FIG. 3), the male section (FIG. 4), the plug (FIG. 8) and other pieces or elements which make up the decompression and self-cleaning mechanisms, which, due to their shapes, dimensions and location in the emitter, permit a full operation of the same in the regulation of its flow and self-cleaning action.

Once the male and female section are assembled, the micro-filter (10) is formed at the base of the pivot (11) which is made up of the internal wall (12) of the pivot (11) and the basal grooved section (13) of the rod (14), through which the liquid coming from the flow of water which flows under pressure inside the dripper or micro-sprinkling hoses (15) passes, this will impede the way to all particles of greater dimensions than the filtering space which is formed between the inside wall (12) of the pivot (11) and the grooved basal section (13) of the rod (14). Said particles can be dislodged from the hose (15) through the periodic cleaning which is done during the normal maintenance of unblocking the extreme ends, and by letting the water flow unitl it comes out clean.

Figure 2:
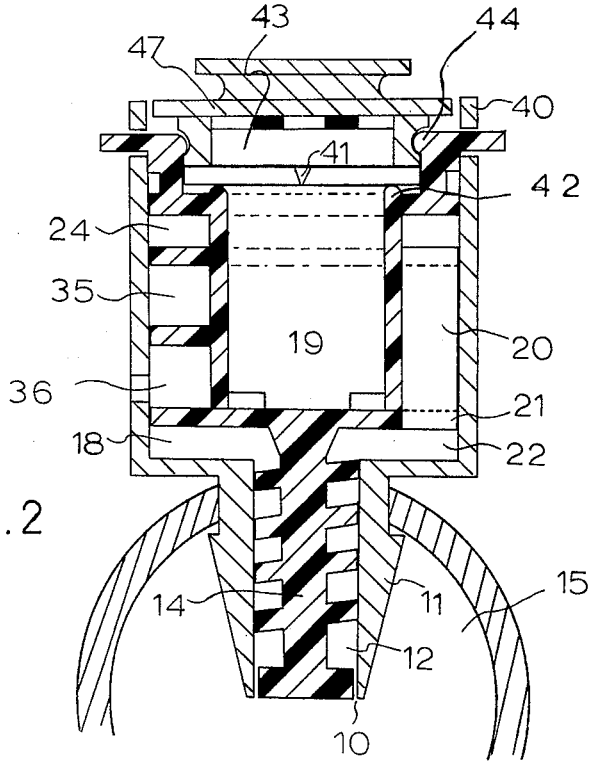
FIG. 2 is a front crossview of the emitter.
Figure 3:
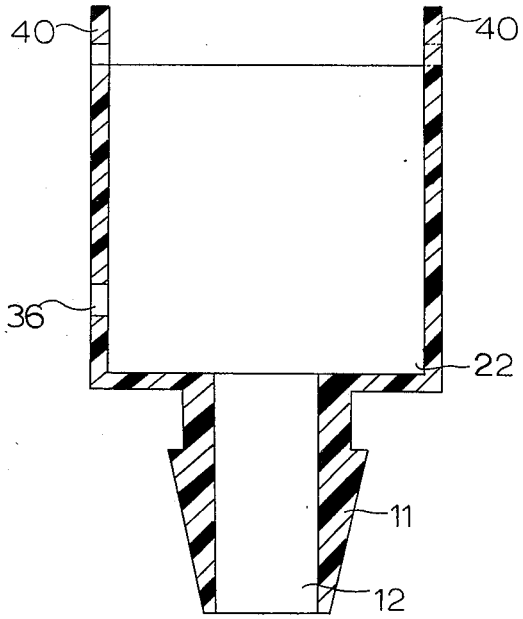
FIG. 3 is a front crossview of the female section.
Figure 4:
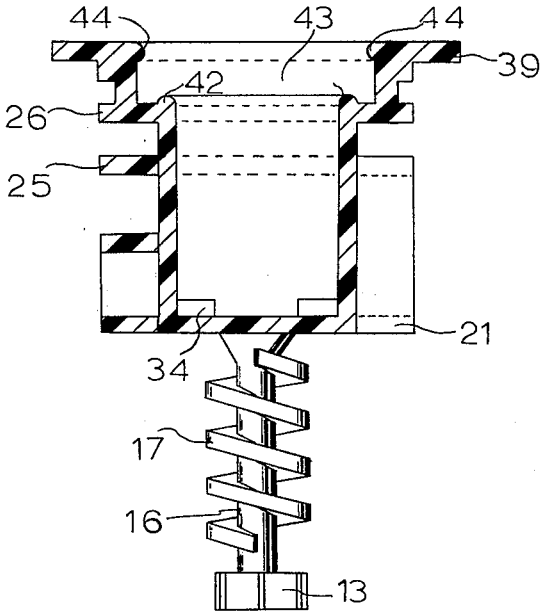
FIg. 4 is a front view of the male section, with part in cross view.
Figure 5:
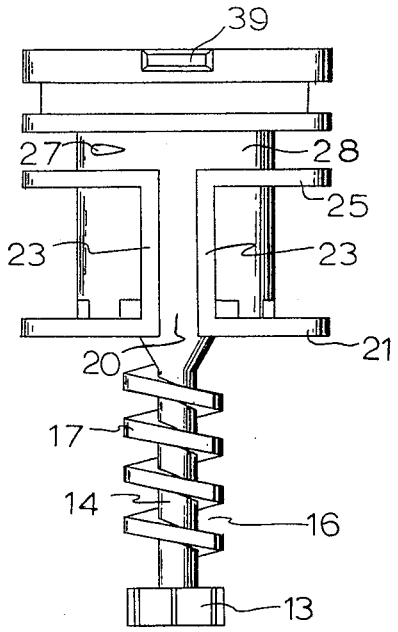
FIG. 5 is a front view corresponding to the side with the groove on the male section.

Once the liquid is filtered, it will follow its trajectory through the spiral duct (16) formed by the spiral rib (17) which forms an integral part of the rod (14) of the male section (FIG. 4) and the inside wall (12) of the pivot (11), of the female section (FIG. 3). Due to the dimensions and length of the duct (16), the water will flow towards the lower chamber (18) at high speed, prohibiting the particles which have managed to pass through the micro-filter (10) to deposit within this duct, blocking little by little in a greater degree the flow of water; through the spiral trajectory of the liquid and the cylindric form of the lower chamber (18), a cyclone-like action will be formed which will also help said liquid to diminish its pressure, not only by the friction within the spiral duct (16), but also by the friction exerted against the wall (22) of the lower reception chamber (18), which is formed by a basal ring (21) which forms an integral part of the male section (FIG. 5) and the inside walls (22) of the female section (FIG. 2).

Figure 9A:
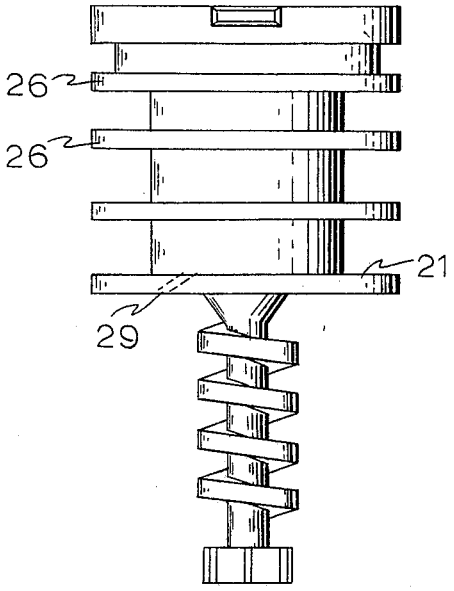
FIGS. 9A, 9B and 9C are front views of different options for the male section.
Figure 9B:
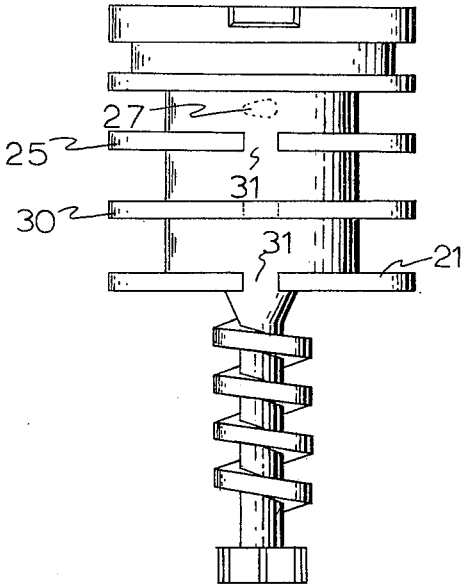

From this inside chamber (18) the liquid will continue flowing towards the second decompression chamber (19), through the different methods which FIGS. (2), (9A), (9B), and (9C) illustrate, and which consist of FIG. 2 through a channel (20) formed by two ribs which interrupt the continuity of the basal ring (21), forming the entrance to the channel (20) where the water will go towards the upper reception chamber (24) which is formed by the rings (25 and 26) which form an integral part of the male section (FIG. 5); the ring (25) will also be interrupted by the ribs (23), forming the exit from the channel (20); once the liquid is in this reception chamber (24) it will go into the second decompression chamber (19), through a diagonal orifice (27) which goes through the wall (28) of said chamber (19). In the case of the first option (FIG. 9A) the water will flow towards the second decompression chamber (19) through the diagonal orifice (29) which goes through the bottom of the basal ring (21), the rest of the rings (25 and 26) will be used only to correctly couple the male section (FIG. 9A) within the female section (FIG. 3). In the case of the option in (FIG. 9B) all the rings (21, 25 and 30) will be interrupted in a specified section (31) in an alternating and opposite manner, in such a way that the water will have a much longer path to travel than that shown in FIG. 5, which will permit a greater loss of pressure before entering into the second decompression chamber (19) through the diagonal entrance orifice (27).

Figure 9C:
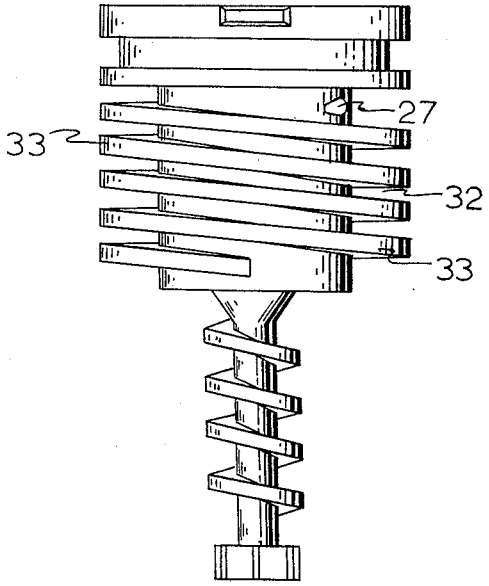

In the case of FIG. 9C the channel (32) which will carry the water towards the second decompression chamber (19) will be continuous spiral which will be formed by a spiral rib (33), which forms an integral part of the male section (FIG. 9C) and by the inside wall (22) of the female section (FIG. 3) and which will lead to the diagonal entrance orifice (27) of the second decompression chamber (19).

Figure 6:
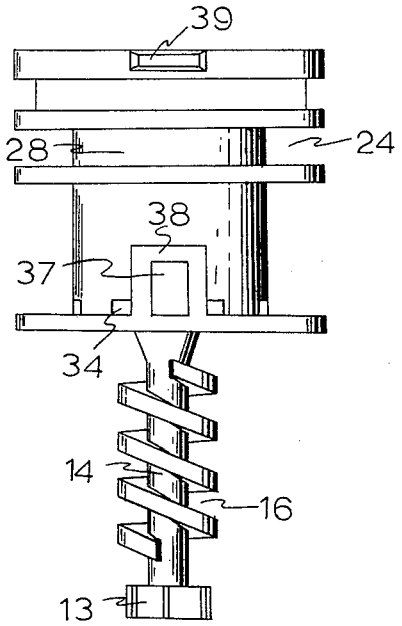
FIG. 6 is a front view corresponding to the side with the flood-gate on the male section.

As the liquid flows towards the second decompression chamber (19) through the diagonal entrance orifice (27), it will form a cyclone-like action inside due to the cylindrical form of said chamber (19). This cyclone-like action will separate the heavier particles, precipitating them towards the walls (28) of the chamber (19) and down-wards where said chamber (19) has exit grooves (34) which communicate with the peripheric chamber (35), where they will accumulate and can be flushed out through the orifice (36) of the cleaning valve that is formed by the flood-gate (37), made up to some ribs (38) in a quadrangular form which form an integral part of the male section (FIG. 6). The flushing of the particles will be achieved by opening the cleaning valve by manually turning the male section (FIG. 4) inside of the female section (FIG. 3) through the pressure which is exerted manually on the lugs (39), at the same time securing the female section (FIG. 1) by way of the flat sections (50) which are found in its periphery, this action will dislodge the lugs (39) out of the cavities formed by the clasps (40) which are also used to fasten the male section (FIG. 4) into correct position with the female section (FIG. 3), not letting the male section be ejected by the pressure of the flow of water.

When the cyclone-like action of the water is formed within the second decompression chamber (19), the water now cleaned of the particles will flow through the orifice (41) of the pressure compensator mechanism (FIGS. 7 and 7A) or the self-cleaning mechanism (FIG. 7B), whichever has been selected for the particular use.

The self-cleaning mechanism (FIG. 7B) will be used when one wishes to use the emitter in irrigation systems which have water of low quality, and economic filtration equipment, and the pressure compensator mechanism (FIGS. 7 and 7A) will be used when it is necessary to compensate the changes in pressure or high pressure due to the topography of the terrain or high pressure from the water supply source.

The compensator mechanism or the self-cleaning mechanism (FIGS. 7, 7A and 7B) will be placed on the outer edge (42) of the walls (28) of the second decompression chamber (19) and will fit into the reception chamber (43) of whose extended walls the lugs (39) will be formed, which also form an integral part of the reception chamber (43); the plug (FIG. 8) is fastened through a circular lock (44) which couples with the peripheric channel (45) which is found on the skirt (46) of the plug (FIG. 8) that will also be perforated (47) around the edges to have multiple exits for the water towards the outside and which will at the same time prohibit the entrance of foreign particles into the inside of the emitter and therefore prohibit the formation of precipitates of salts due to the evaporation of water directly on the final exit orifice (41). The plug will also have a circular cover (48) which covers the upper outer edge of the walls of the female section (FIG. 3); on this cover (48) the plug (FIG. 8) will have integrated in it a handle (49) which can be used to extract the plug (FIG. 8) when this is desired.

Figure 10D:
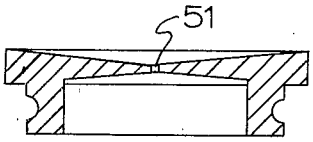
FIGS. 10D and 10E are front crossviews of two options for sprinkling heads.
Figure 10E:
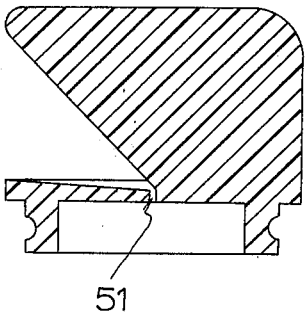

When one wants to use the emitter as a sprinkler the plug (FIG. 8), the compensator mechanism or self-cleaning mechanism (FIGS. 7, 7A and 7B) will be substituted by a sprinkler head (FIGS. 10D and 10E) which has an integrated exit duct (51).

I claim:

1. An emitter for discharging fluid from a conduit conveying fluid in an irrigation system, said emitter comprising a male section and a female section, said female section having a pivot insertable in said conduit with a passageway in said pivot providing for fluid communication between said conduit and emitter, a rod extending from said male section into said passageway and being formed to provide restricted passage of fluid from said conduit into said emitter so as to impede the passage of particles suspended in said fluid, a first decompression chamber formed between the male section and the female section and communicating with said passageway, a second decompression chamber in fluid communication with said first decompression chamber, means to create a cyclone like turbulence in the fluid flowing into said chambers, a particle collecting chamber formed around the periphery of said emitter, an opening providing for communication between said particle collecting chamber and said second decompression chamber, said opening being sized to permit the passage of particles from said second decompression chamber into said collecting chamber, an opening formed in the body of said emitter to provide for exit of particles from said particle collecting chamber, manually operable means to selectively provide for exit of said particles from the collecting chamber, and means combined with said male and female sections providing for discharge of fluid from said emitter.

2. The emitter of claim 1 in which said rod is provided with means combined with the passageway walls of said pivot to form a spiral path for the fluid after passing through the restricted passage that impedes particles suspended in said fluid.

3. The emitter of claim 2 in which said female section has a wall extending from said pivot to form a hollow body, and said first decompression chamber is formed by an outwardly extending ring on said male section and the wall of said female section.

4. The emitter of claim 3 in which said male section has a wall extending from said rod inside of the body of said female section, said second decompression chamber is formed inside of said wall of said male section, and an opening is provided in the wall of said male section to provide for fluid flow into said second decompression chamber from said first decompression chamber.

5. The emitter of claim 4 in which said particle collecting chamber is formed around the periphery of said second decompression chamber between the wall of said male section and the wall of said female section, the wall of said male section having exit openings that provide for the passage of particles from the second decompression chamber into the particle collecting chamber, and means is provided for relative movement of said male section within said female section to allow particles to exit from the collecting chamber through the body of the emitter.

6. The emitter of claims 1, 2, 3, 4 or 5 in which said second decompression chamber is provided with pressure compensating means which means provides for discharge of the fluid from said emitter, said pressure compensating means being formed of elastic material having a discharge orifice therein.

7. The emitter of claims 1, 2, 3, 4 or 5 in which said second decompression chamber is provided with a sprinkler head that provides for discharge of the fluid from said emitter.

* * * * *